US008476858B2

(12) United States Patent
Eom et al.

(10) Patent No.: US 8,476,858 B2
(45) Date of Patent: Jul. 2, 2013

(54) REFRIGERATOR AND METHOD FOR CONTROLLING SAME

(75) Inventors: Yong Hwan Eom, Seoul (KR); Myung Keun Yoo, Seoul (KR); Hyoun Jeong Shin, Seoul (KR); Ok Sun Yu, Seoul (KR); Young Jin Kim, Seoul (KR); Seung Do Han, Seoul (KR)

(73) Assignee: LG Electronics Inc., Seoul (KR)

( * ) Notice: Subject to any disclaimer, the term of this patent is extended or adjusted under 35 U.S.C. 154(b) by 545 days.

(21) Appl. No.: 12/724,571

(22) Filed: Mar. 16, 2010

(65) Prior Publication Data

US 2010/0236278 A1 Sep. 23, 2010

(30) Foreign Application Priority Data

Mar. 20, 2009 (KR) ..... 10-2009-0024204

(51) Int. Cl.
*H02P 1/04* (2006.01)

(52) U.S. Cl.
USPC ..... 318/466; 318/257; 318/266; 318/282; 318/467

(58) Field of Classification Search
USPC ..... 318/256, 257, 264, 265, 280, 282, 318/286, 466, 467, 468; 49/26, 28
See application file for complete search history.

(56) References Cited

U.S. PATENT DOCUMENTS

| | | | | |
|---|---|---|---|---|
| 2,873,159 | A | 2/1959 | Otto | |
| 4,829,429 | A * | 5/1989 | Komai et al. | 705/18 |
| 5,280,227 | A * | 1/1994 | Bashark | 318/751 |
| 5,392,951 | A | 2/1995 | Gardner et al. | |
| 5,445,294 | A | 8/1995 | Gardner et al. | |
| 5,775,786 | A | 7/1998 | Liebertz | |
| 5,899,083 | A | 5/1999 | Peterson et al. | |
| 5,940,306 | A | 8/1999 | Gardner et al. | |
| 6,130,621 | A | 10/2000 | Weiss | |
| 6,445,152 | B1 * | 9/2002 | Calamatas | 318/445 |
| 6,751,909 | B2 | 6/2004 | Ranaudo | |
| 6,779,855 | B2 | 8/2004 | Hoffman | |
| 7,006,876 | B2 | 2/2006 | Ross | |
| 7,063,398 | B2 | 6/2006 | Hoffman | |
| 7,075,446 | B2 | 7/2006 | Schondelmaier et al. | |
| 7,121,099 | B2 * | 10/2006 | Shimizu et al. | 62/6 |
| 7,197,888 | B2 | 4/2007 | LeClear et al. | |
| 7,282,884 | B2 | 10/2007 | Huber et al. | |
| 7,307,395 | B2 | 12/2007 | Bouamra et al. | |

(Continued)

FOREIGN PATENT DOCUMENTS

| | | | |
|---|---|---|---|
| CN | 2406551 | A | 11/2000 |
| CN | 1468569 | A | 1/2004 |

(Continued)

OTHER PUBLICATIONS

U.S. Office Action issued in U.S. Appl. No. 12/345,946 dated May 19, 2011.

(Continued)

*Primary Examiner* — Walter Benson
*Assistant Examiner* — Thai Dinh
(74) *Attorney, Agent, or Firm* — KED & Associates, LLP

(57) ABSTRACT

A refrigerator and a method for controlling the same are provided. In this refrigerator and control method, a receiving box may be automatically drawn in and out together with a door based on a movement command received at an input unit, thus enhancing user convenience and satisfaction.

12 Claims, 9 Drawing Sheets

U.S. PATENT DOCUMENTS

| | | | | |
|---|---|---|---|---|
| 7,407,210 | B2 | 8/2008 | Arbaugh et al. | |
| 7,430,937 | B2 | 10/2008 | Rotter et al. | |
| 7,484,817 | B2 | 2/2009 | Hoffman et al. | |
| 7,533,947 | B2 | 5/2009 | Kim et al. | |
| 7,587,907 | B2 | 9/2009 | Kim et al. | |
| 7,594,707 | B2 | 9/2009 | Kunkle et al. | |
| 7,602,135 | B2 * | 10/2009 | Huber et al. | 318/651 |
| 7,633,258 | B2 | 12/2009 | Huber et al. | |
| 7,641,707 | B2 | 1/2010 | Kang et al. | |
| 7,688,015 | B2 | 3/2010 | Wenzel et al. | |
| 7,731,314 | B2 | 6/2010 | Kim | |
| 7,784,888 | B2 | 8/2010 | Oh et al. | |
| 7,800,477 | B1 | 9/2010 | Komer | |
| 7,802,515 | B2 | 9/2010 | Suetsugu | |
| 7,812,561 | B2 | 10/2010 | Hagen et al. | |
| 7,859,203 | B2 * | 12/2010 | Miyashita | 318/266 |
| 7,868,578 | B2 | 1/2011 | Scheffknecht et al. | |
| 7,928,684 | B2 | 4/2011 | Hauer | |
| 8,067,915 | B2 * | 11/2011 | Hooker et al. | 318/466 |
| 8,074,468 | B2 | 12/2011 | Yoo et al. | |
| 8,134,313 | B2 * | 3/2012 | Zipp | 318/282 |
| 8,141,968 | B2 | 3/2012 | Velarde et al. | |
| 8,169,175 | B2 | 5/2012 | Yu et al. | |
| 8,169,176 | B2 * | 5/2012 | Yu et al. | 318/466 |
| 8,217,613 | B2 | 7/2012 | Yoo et al. | |
| 8,274,251 | B2 * | 9/2012 | Yoo et al. | 318/466 |
| 8,282,177 | B1 | 10/2012 | Rotter | |
| 2001/0009360 | A1 | 7/2001 | Jin | |
| 2002/0171335 | A1 | 11/2002 | Held | |
| 2003/0078710 | A1 | 4/2003 | Li | |
| 2004/0035129 | A1 | 2/2004 | Kaiser | |
| 2004/0100165 | A1 | 5/2004 | Hoffman | |
| 2004/0100166 | A1 | 5/2004 | Hoffman | |
| 2004/0100169 | A1 | 5/2004 | Huber et al. | |
| 2004/0138843 | A1 | 7/2004 | Bouamra et al. | |
| 2005/0128660 | A1 | 6/2005 | Dlugosz | |
| 2005/0284113 | A1 | 12/2005 | Jang et al. | |
| 2006/0042301 | A1 | 3/2006 | Oh et al. | |
| 2006/0061245 | A1 | 3/2006 | Huber et al. | |
| 2006/0087207 | A1 | 4/2006 | Oh et al. | |
| 2006/0087208 | A1 | 4/2006 | Oh et al. | |
| 2006/0096304 | A1 | 5/2006 | Kim et al. | |
| 2006/0104756 | A1 | 5/2006 | Kim et al. | |
| 2006/0196198 | A1 | 9/2006 | Kim et al. | |
| 2006/0207283 | A1 | 9/2006 | Kim et al. | |
| 2006/0226749 | A1 | 10/2006 | Kim | |
| 2006/0242988 | A1 | 11/2006 | Kim et al. | |
| 2006/0261775 | A1 | 11/2006 | Huber et al. | |
| 2006/0267461 | A1 | 11/2006 | Hoffman | |
| 2007/0013274 | A1 | 1/2007 | Hoffman | |
| 2007/0170828 | A1 | 7/2007 | Hoshide et al. | |
| 2007/0256036 | A1 | 11/2007 | Johnson et al. | |
| 2008/0018215 | A1 | 1/2008 | Carden et al. | |
| 2008/0110092 | A1 | 5/2008 | Takahashi | |
| 2008/0116777 | A1 | 5/2008 | Kappler et al. | |
| 2008/0163639 | A1 | 7/2008 | Hwang | |
| 2008/0302114 | A1 | 12/2008 | Kelly et al. | |
| 2008/0314067 | A1 | 12/2008 | Lee | |
| 2009/0026906 | A1 | 1/2009 | Kim | |
| 2009/0091223 | A1 | 4/2009 | Hagen et al. | |
| 2009/0102338 | A1 | 4/2009 | Wenzel et al. | |
| 2009/0160297 | A1 | 6/2009 | Anikhindi et al. | |
| 2009/0199484 | A1 * | 8/2009 | Zipp | 49/358 |
| 2009/0206715 | A1 | 8/2009 | Scheffknecht et al. | |
| 2009/0243454 | A1 | 10/2009 | Yoo et al. | |
| 2009/0248205 | A1 | 10/2009 | Yu et al. | |
| 2009/0248207 | A1 | 10/2009 | Yoo et al. | |
| 2009/0254221 | A1 | 10/2009 | Kang | |
| 2009/0261698 | A1 | 10/2009 | Cabal Velarde et al. | |

FOREIGN PATENT DOCUMENTS

| | | |
|---|---|---|
| CN | 101358792 A | 2/2009 |
| EP | 0779484 | 6/1997 |
| JP | 02-103388 | 4/1990 |
| JP | 02-106686 | 4/1990 |
| JP | 02-136686 | 5/1990 |
| JP | 02-146487 | 6/1990 |
| JP | 03-045820 | 2/1991 |
| JP | 07-174459 | 7/1995 |
| JP | 11-094455 | 4/1999 |
| JP | 2005-326044 | 11/2005 |
| JP | 2006-023039 | 1/2006 |
| JP | 2006-046741 | 2/2006 |
| JP | 2006-046748 | 2/2006 |
| JP | 2006-145055 | 6/2006 |
| JP | 2006-250485 | 9/2006 |
| JP | 2007-017018 | 1/2007 |
| JP | 2007-093208 | 4/2007 |
| JP | 2007-132605 | 5/2007 |
| JP | 2008-8550 | 1/2008 |
| JP | 2008-196744 | 8/2008 |
| JP | 2008-196752 | 8/2008 |
| JP | 2009-036433 | 2/2009 |
| KR | 1999-003684 | 1/1999 |
| KR | 20-0301747 | 1/2003 |
| KR | 20-0334077 | 11/2003 |
| KR | 10-2006-0025806 | 3/2006 |
| KR | 10-0634366 | 10/2006 |
| KR | 10-2007-0008046 | 1/2007 |
| WO | WO 2006/126584 | 11/2006 |
| WO | WO 2007/009783 | 1/2007 |

OTHER PUBLICATIONS

U.S. Office Action issued in U.S. Appl. No. 12/345,984 dated May 23, 2011.

Notice of Allowance issued in U.S. Appl. No. 12/390,523 dated Jun. 27, 2012.

Final Office Action issued in U.S. Appl. No. 12/724,558 dated Aug. 13, 2012.

Office Action issued in U.S. Appl. No. 12/724,606 dated Sep. 13, 2012.

Chinese Office Action issued in CN Application No. 2011092100646340 dated Sep. 26, 2011.

U.S. Office Action issued in U.S. Appl. No. 12/510,372 dated Nov. 30, 2011.

International Search Report issued in PCT Application No. PCT/KR2008/001694 dated Dec. 3, 2008.

International Search Report issued in PCT Application No. PCT/KR2008/001696 dated Dec. 3, 2008.

International Search Report issued in PCT Application No. PCT/KR2008/001697 dated Dec. 3, 2008.

International Search Report issued in PCT Application No. PCT/KR2008/001695 dated Dec. 8, 2008.

International Search Report issued in PCT Application No. PCT/KR2010/001497 dated Oct. 22, 2010.

International Search Report issued in PCT Application No. PCT/KR2010/001496 dated Oct. 22, 2010.

International Search Report issued in PCT Application No. PCT/KR2010/001495 dated Oct. 25, 2010.

International Search Report issued in PCT Application No. PCT/KR2010/001409 dated Oct. 25, 2010.

International Search Report issued in PCT Application No. PCT/KR2010/001410 dated Oct. 25, 2010.

U.S. Office Action issued in U.S. Appl. No. 12/390,520 dated Apr. 22, 2011.

U.S. Office Action issued in U.S. Appl. No. 12/390,524 dated Aug. 25, 2011.

U.S. Office Action issued in U.S. Appl. No. 12/345,946 dated Sep. 26, 2011.

U.S. Office Action issued in U.S. Appl. No. 12/345,984 dated Sep. 26, 2011.

U.S. Office Action issued in U.S. Appl. No. 12/390,523 dated Feb. 7, 2012.

U.S. Office Action issued in U.S. Appl. No. 12/390,527 dated Feb. 14, 2012.

U.S. Office Action issued in U.S. Appl. No. 12/724,58 dated Mar. 14, 2012.

Chinese Office Action issued in CN Application No. 201080012399.5 dated Oct. 24, 2012.

U.S. Notice of Allowance issued in U.S. Appl. No. 12/724,648 dated Nov. 9, 2012.
U.S. Office Action issued in U.S. Appl. No. 12/726,643 dated Dec. 5, 2012.
U.S. Office Action issued in U.S. Appl. No. 12/724,606 dated Jan. 11, 2013.
Chinese Office Action issued in CN Application No. 201080012987.9 dated Dec. 12, 2012.
U.S. Office Action issued in U.S. Appl. No. 12/724,558 dated Mar. 5, 2013.

* cited by examiner

REFRIGERATOR AND METHOD FOR CONTROLLING SAME

CROSS REFERENCES RELATED APPLICATIONS

This claims priority under 35 U.S.C. 119 and 35 U.S.C. 365 to Korean Patent Application No. 10-2009-0024204 (filed in Korea on Mar. 20, 2009), the entirety of which is incorporated herein by reference.

BACKGROUND

1. Field

This relates to a refrigerator and a method for controlling the same.

2. Background

Generally, a refrigerator stores items in a refrigerated or frozen state. Refrigerators may be classified as a top mount type refrigerator, a bottom freezer type refrigerator or a side by side type refrigerator, depending on the relative locations of a freezing chamber and a refrigerating chamber.

BRIEF DESCRIPTION OF THE DRAWINGS

Embodiments will be described in detail with reference to the following drawings in which like reference numerals refer to like elements wherein.

DETAILED DESCRIPTION

Figure 1:
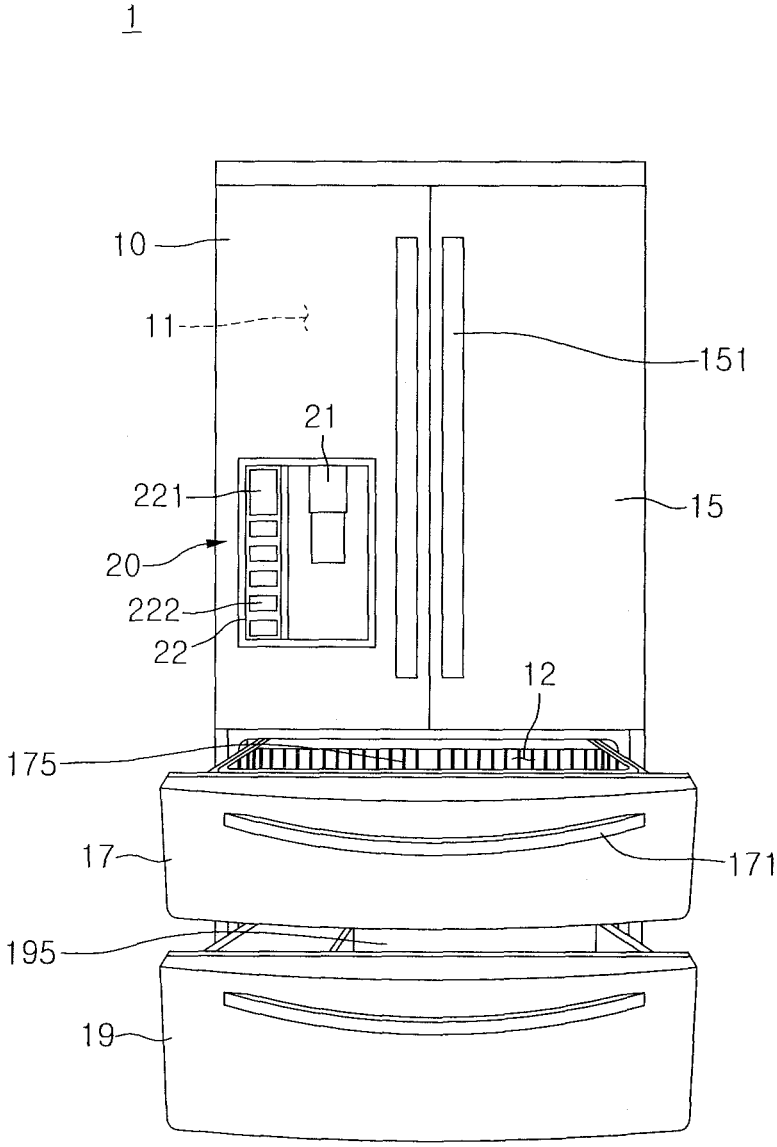
FIG. 1 is a front view of an exemplary refrigerator according to an embodiment as broadly described herein.

In the following detailed description, reference is made to the accompanying drawings that form a part hereof, and in which is shown by way of illustration of various embodiments. These embodiments are described in sufficient detail to enable those skilled in the art, and it is understood that other embodiments may be utilized and that logical structural, mechanical, electrical, and chemical changes may be made without departing from the spirit or scope as embodied and broadly described herein. The following detailed description is not to be taken in a limiting sense.

In a bottom freezer type refrigerator, a freezing chamber is positioned below a refrigerating chamber, a refrigerating chamber door is rotatably mounted at an edge of one side of a refrigerator main body to open and close the refrigerating chamber, and a freezing chamber door to open and close the freezing chamber may be provided in such a way that it is drawn into and out of the freezing chamber together with a receiving box in a drawer like fashion. Because the freezing chamber is below the refrigerating chamber, when the user opens the freezing chamber, the user must bend at the waist to pull the door of the freezing chamber forward, requiring more effort than when pulling the freezing chamber door in a standing position.

In a bottom freezer type refrigerator without a structure for automatically drawing out the receiving box, a user may pull on a handle provided the front surface of the receiving box to gain access to the receiving box positioned within the freezing chamber. However, a sealing member such as a gasket may be provided at a rear surface of the door to prevent cool air leakage, and the inside of the sealing member may include a close adhesion member such as a magnet, so that when the door is closed and the receiving box is positioned within the freezing chamber, it is closely adhered to the main body of the refrigerator by magnetic force. This requires that the user apply a force greater than the magnetic force when pulling on the handle in order to break the seal therebetween and draw out the receiving box. This may be more difficult when the freezing chamber is provided at the lower portion of the refrigerator, as the user must bend at the waist while also pulling.

Further, such a handle typically protrudes from the front surface of the receiving box, increasing a volume of packing materials in the refrigerator. When the refrigerator is installed in a room, a space corresponding to the protruded portion of the handle is occupied by the handle, thus degrading space utilization in the room. Further, a handle that protrudes from the front surface of the refrigerator may pose a risk of injury to occupants of the room.

A partially automatic opening structure that moves the freezing chamber door by a predetermined distance from a front surface of the main body has been developed to address this problem. This partially automatic opening structure senses the user's motion of holding and/or initial pull on a door handle to open the freezing chamber door.

Upon sensing this contact with/force exerted on the handle, a receiving box separating device pushes the receiving box by a predetermined distance to separate it from the main body of the refrigerator. However, in this type of automatic opening structure, the handle is an essential component. As a result, a refrigerator having this type of separating device has similar problems to those set forth above. Further, time is consumed as the structure senses when the user holds the handle and draws out the receiving box, thus degrading efficiency. That is, the reaction time of this type of receiving box separating device may not significantly improve user convenience. Additionally, since the receiving box separating device simply pushes the receiving box by a predetermined distance to separate the receiving box from the main body of the refrigerator, the user must still pull the handle after the initial separation to fully open the receiving box. When a weight of items received in the receiving box is heavy, it may be difficult to fully draw out the receiving box manually.

A motor that is fixed to a bottom surface of the freezing chamber has also been developed to draw the freezing chamber door and receiving box out using a driving force of the motor. More specifically, the motor may be fixed to the bottom surface of the freezing chamber and a rotation member, for example, a gear may be connected to a rotational shaft of the motor. The bottom surface of the receiving box contacts the rotational member, such that the receiving box moves forward and backward depending on the direction of rotation of the rotational member.

In a refrigerator having a driving motor and a gear assembly provided at the bottom surface of the refrigerating chamber or the freezing chamber, a storage volume of the refrigerator may be reduced accordingly. The driving motor and the gear assembly may be installed in a recess formed in an inner case of the refrigerator to compensate for the loss of storage volume. However, this may require removal of a heat shield layer typically mounted between the inner and outer case of the main body, or for the heat shield layer to be thinner, such that the heat shield effect between the inside of the refrigerator and the interior of a room is degraded.

Additionally, the motor and the gear assembly would typically engage a rack mounted along the bottom surface of the receiving box in a front to back direction, a maximum length of the rack corresponding to the entire length of the bottom surface of the receiving box. A machine room in which components such as a compressor and a condenser are received is typically provided at a rear lower portion of the refrigerator, causing the rear surface of the receiving box of the freezing chamber to be inclined in a bottom freezer type refrigerator. Thus, the entire length of a lower end of the receiving box of the freezing chamber is less than the entire length of an upper end of the receiving box of the freezing chamber. In this case, when the receiving box of the freezing chamber is drawn fully out, the rear portion of the upper end of the receiving box of the freezing chamber is not completely drawn out and not accessible.

Further, when a plurality of receiving boxes are vertically mounted in the refrigerator, a separate motor and gear assembly may be required for each receiving box, also requiring separate barriers at upper and lower sides of the receiving boxes.

Additionally, a refrigerator having such a motor structure may sense whether the receiving box is completely drawn out or completely closed using, for example, lead switches on the front end and rear end of the rack that is installed on the bottom surface of the refrigerator. However, the refrigerator cannot sense whether the receiving box is drawn in or out at a normal speed, whether the operation of drawing the receiving box in or out is hindered by an obstacle, or whether the receiving box is drawn in or out at a set speed, regardless of the weight of items received in the receiving box.

At times, when drawing out the receiving box, if the receiving box is moved to a movable maximum distance by a motor, a collision sound may occur in a slide assembly that moves the receiving box. This may lead to user concerns regarding durability. Further, if the slide rail repetitively collides with a stopper, components may be damaged or worn.

Additionally, such a collision may cause the receiving box to move back by a predetermined distance due to the impact or the repulsive force caused by the collision between the slide rail and the stopper.

Further, when the receiving box is drawn in, the receiving box may rebound forward by a predetermined distance due to the repulsive force or impact of the gasket of the receiving box on the main body at the moment that the receiving box is closed. In this case, the receiving box may not be completely closed, and cool air may leak from the storage space.

Additionally, after the drawing in order has been input, the user may extend a hand/arm into the receiving box in order to draw additional items out of the receiving box, presenting possible safety problems in that the user's hand may be caught in the receiving box.

As shown in FIG. 1, a refrigerator 1 according to an embodiment as broadly described herein may include a main body 10 having a storage space formed therein. The storage space may include at least one of a refrigerating chamber 11 that stores items at an appropriate temperature and a freezing chamber 12 that freezes and stores items at an appropriate temperature. In this exemplary embodiment, the refrigerating chamber 11 is positioned at an upper side of the main body 10 and the freezing chamber 12 is positioned at a lower side of the main body 10. Other arrangements may also be appropriate.

The refrigerating chamber 11 may be selectively opened and closed by one or more refrigerating chamber doors 15 that may be rotatably coupled to the front surface of the main body 10, and that may include a handle 151 that may be grasped by a user.

The freezing chamber 12 may be selectively opened and closed by one or more freezing chamber doors 17 and 19. In the embodiment shown in FIG. 1, the freezing chamber 12 is partitioned into two spaces individually opened and closed by an upper door 17 that opens and closes an upper space of the freezing chamber 12 and a lower door 19 that opens and closes a lower space of the freezing chamber 12. The doors 17 and 19 and receiving boxes 175 and 195 respectively fixed thereto may be drawn into and out of the freezing chamber 12 in a drawer like fashion. Other arrangements, such as a single freezing chamber door, side by side freezing chamber doors, and the like, may also be appropriate based on user preferences.

The upper door 17 may be slidably drawn in and out to open and close the upper space of the freezing chamber 12. The receiving box 175 may be attached to a rear side of the upper door 17, and be attached to and detached from a slide assembly 30 (see FIG. 2) that moves the upper door 17 forward and backward. A rail connector 34 may be coupled to the slide assembly 30 and the receiving box 175 so as to be drawn in and out together with the upper door 17. A handle 171 may be provided on the front surface of the upper door 17 to be grasped by a user and move the upper door 17. The upper door 17 may be manually drawn in and out by a user grasping the handle 171 and pulling/pushing. Alternatively, the upper door 17 may be automatically drawn in and out in response to a user command received at an input unit.

The lower door 19 may be slidably moved in a manner similar to the upper door 17 so as to open and close the lower space of the freezing chamber 12. In this embodiment, the freezing chamber 12 is closed by two doors. However, in alternative embodiments, the freezing chamber 12 may be opened and closed by one door, or by more than two doors.

One of the refrigerating chamber doors 15 may be provided with a dispenser 20 including a dispensing unit 21 that dispenses water and/or ice and an operation unit 22. The operation unit 22 may include a display device 221 that displays the operation state of the dispenser 20 or the refrigerator 1 and a plurality of buttons that control operations of the dispenser 20, the refrigerator 1, and other components.

Simply for ease of discussion, hereinafter, the movement of the upper door 17 and receiving box 175 attached thereto will be described. However, it is well understood that the concepts set forth herein may be applied to other doors/receiving boxes provided in both the freezing chamber 12 and the refrigerating chamber 11.

The operation unit 22 may also include an input unit 222 that receives an input for sliding and drawing in and out the door 17/receiving box 175. The input unit 222 may be, for example, a capacitance switch that operates based on a change in capacitance, a tact switch, a toggle switch, or other type of switch as appropriate. For example, the input unit 222 may be a user voice recognizing device, a sound recognizing device, a light sensing device, a touch screen device, a keypad, or other such device.

The input unit 222 may be provided at the dispenser 20 or at the operation unit 22, or may be independently provided at the front surfaces or side surfaces of one the doors 15, 17, and 19. Other locations may also be appropriate.

For example, the input unit 222 may be provided at one side of the front surface of the particular door that is equipped to be automatically opened, and may be a vibration sensing switch that senses vibration transferred to the door. In other words, a weak impact may be to the door using, for example, the user's foot in a situation where the user's hands are both full. In this instance, the vibration sensing unit senses vibration transferred from the impact, and operates the door such that the door can be slidably drawn in and out.

In certain embodiments, the input unit 222 may be provided as a single button so that it may receive all drawing in and out commands of the door 17. Alternatively, a first button may be provided to receive the drawing out command, and a second button may be provided to receive the drawing in command. For example, in the case where the input unit 222 is provided as a single button, the input unit 222 may be configured so that if the button is pressed when the door 17 is drawn in, the pressing of the single button is determined to be a drawing out command. Similarly, if the button is pressed when the door 17 is drawn out, the pressing of the single button is determined to be a drawing in command. In this case, if the button is pressed as the door 17 is moving or the button is continuously pressed for a predetermined time, it may be determined to be a stop command. In other words, a particular user command may be determined based on the pressing frequency and pressing time of the single button provided as the input unit 222.

A machine room may be partitioned from the storage space to generate cool air supplied to the storage space, and may be provided at one side of the main body 10 to house the appropriate components. The machine room may house, for example a compressor that compresses refrigerant at high temperature and high pressure, a condenser that condenses the refrigerant supplied by the compressor, an expander that expands the refrigerant supplied by the condenser to lower the pressure. Refrigerant passing through the expander may be supplied to an evaporator that is provided at one side of the storage space so as to exchange heat with air circulating in the storage space.

Figure 2:
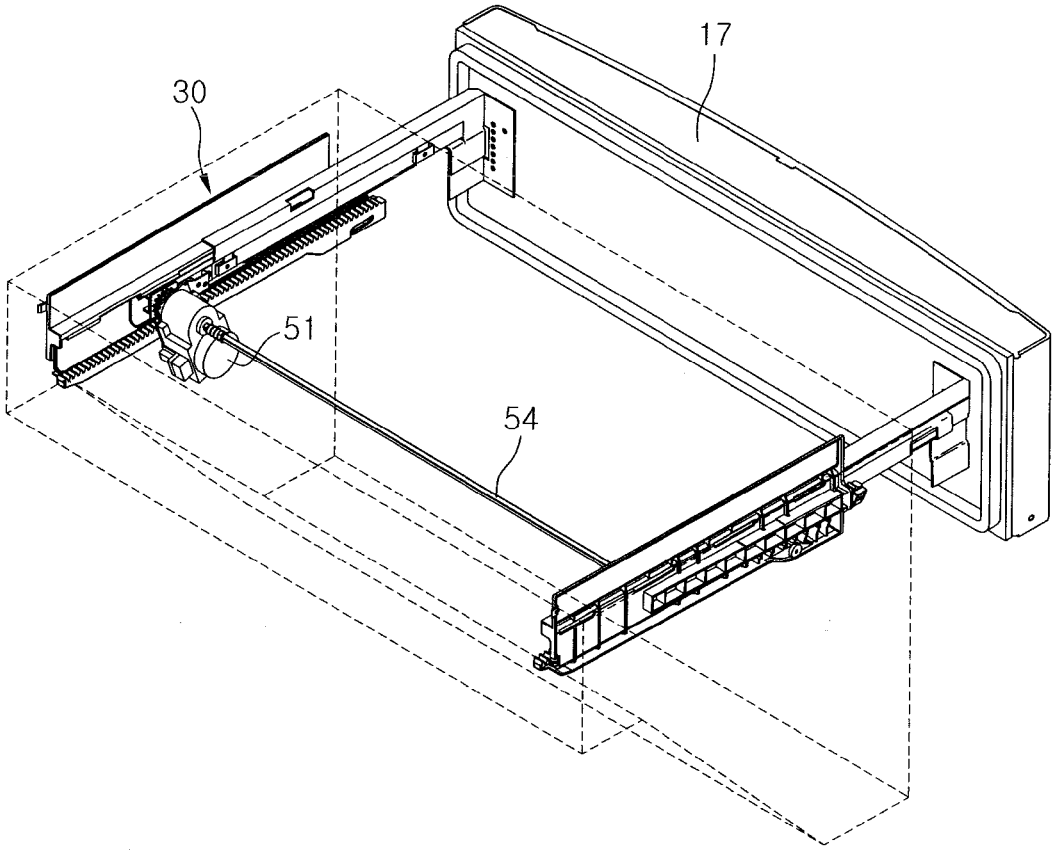
FIG. 2 is a rear perspective view of a door structure of the refrigerator shown in FIG. 1.
Figure 3:
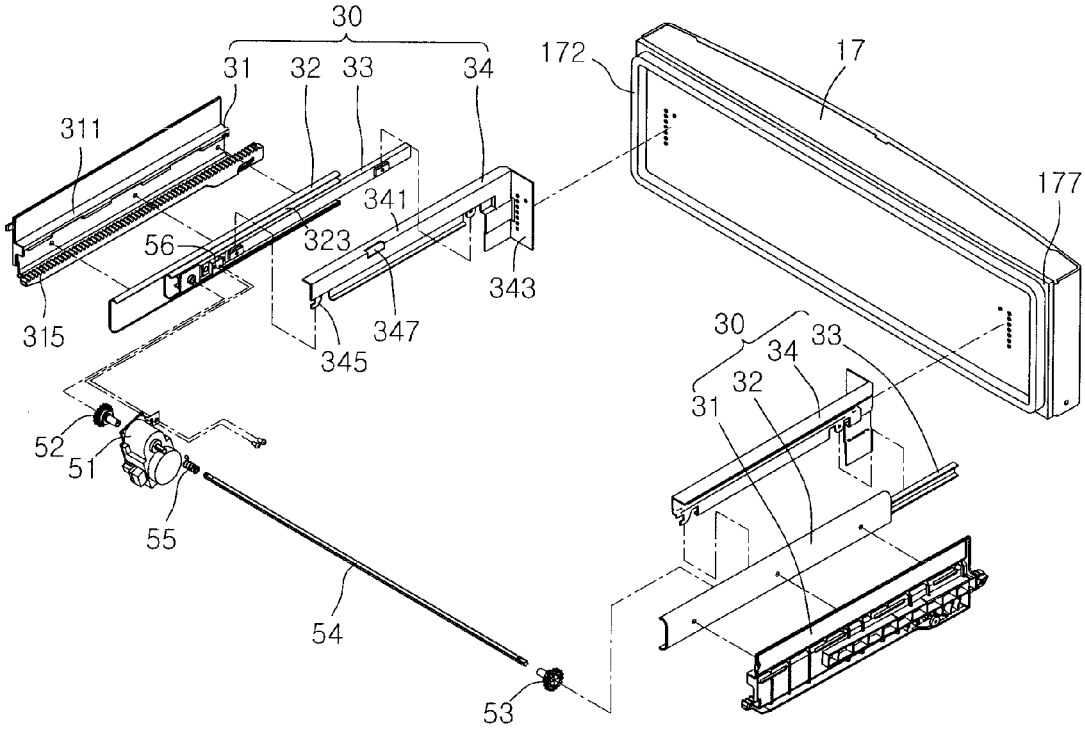
FIG. 3 is an exploded perspective view of the upper door shown in FIG. 2.
Figure 4:
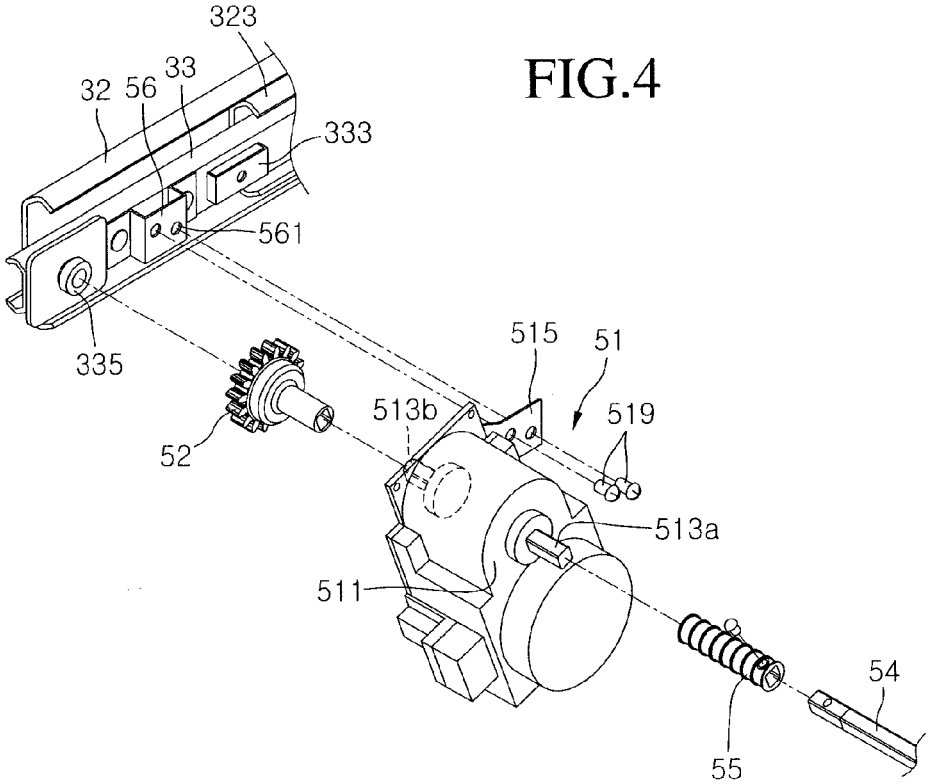
FIG. 4 is an exploded perspective view of a driving assembly coupled to a slide assembly as shown in FIGS. 2 and 3.

Referring to FIGS. 2 to 4, the door 17 may be configured to connect to a slide assembly 30 so as to open and close the corresponding upper portion of the freezing chamber 12. The slide assembly 30 may be fixed to a side wall of the freezing chamber 12, and include a rail connector 34 that is fixed to the door 17. The door 17 may move forward and backward according to the sliding movement of the slide assembly 30, and the receiving box 175 may be removably coupled to the slide assembly 30 or the rail connector 34. In the embodiment shown in FIGS. 2-4, the receiving box 175 is connected to the rail connector 34.

The slide assembly 30 may include a rail guide 31 that is fixed to the inner wall of the freezing chamber 12, a fixing rail 32 that is coupled to the rail guide 31, and a moving rail 33 that is slidably coupled to the fixing rail 32. The moving rail 33 is coupled to the rail connector 34 that is coupled to the rear surface of the door 17.

A rail guide 31 is provided at the two opposite side walls of the freezing chamber 12, respectively, and extends in a direction in which the door 17 is drawn in and out, in the front and rear direction of the refrigerator 1. The rail guide 31 may be firmly coupled to the inner side wall of the freezing chamber 12 by a bolt, or other fastener as appropriate so that the door 17 may be stably supported as it is drawn in and out.

A rack 315 that guides movement of a pinion 52 may be formed at a lower end of the rail guide 31. The rack 315 may protrude by a predetermined distance inward from the lower end of the rail guide 31 toward an interior of the freezing chamber 12 so as to receive the pinion 52 thereon. In addition, the rack 315 may be essentially straight so that the central portion of the pinion 52 may move straight along the rack 315, and the rack 315 may extend from the rear end of the freezing chamber 12 to the front end thereof. The upper end of the rail guide 31 may be somewhat curved toward the interior of the freezing chamber 12 so as to form a supporting part 311 that supports a seating part 341 of the rail connector 34.

The fixing rail 32 is positioned within and coupled to a space formed between the rack 315 and the supporting unit 311 of the rail guide 31. The fixing rail 32 may include a guide part 323 to guide the sliding movement of the moving rail 33. The guide part 323 may include an upper guide and a lower guide that protrude toward the interior of the freezing chamber 12 from upper and lower ends of the fixing rail 32, and that are spaced by a distance corresponding to a width of the moving rail 33. The upper and lower guides may be curved facing each other and may extend a predetermined length so as to retain the moving rail 33 therein during the sliding movement. In other words, the upper and lower guides may be shaped so as to hold the upper side and lower side of the moving rail 33, respectively. The guide part 323 may extend in parallel with the rack 315 so that the moving rail 33 is smoothly moved linearly. The fixing rail 32 may be firmly coupled to the guide rail 31 by a bolt, or other fastener as appropriate so that the door 17 may be stably supported as it is drawn in and out.

The moving rail 33 may be slidably connected to the fixing rail 32. The moving rail 33 may have an elongated plate shape that corresponds to the width of the guide part 323. The upper end and lower end of the moving rail 33 may be formed to correspond to the shape of the guide part 323 and may be seated in the guide part 323 so as to slide forward and backward. The moving rail 33 may include an inserting part, or receiver 333 in which a hooking ring 345 may be inserted. The receiver 333 may protrude a predetermined distance toward the interior of the freezing chamber 12 so as to form a groove into which the hooking ring 345 may be inserted.

The rear end of the moving rail 33 may include a bracket 56 on which a driving motor 51 may be fixedly mounted. The bracket 56 may be formed at a point that is spaced by a predetermined distance to the rear of the receiver 333. The bracket 56 may include a plurality of holes 561 that engage the driving motor 51. The bracket 56 may be fixedly mounted on the moving rail 33 by a rivet, a bolt, or other fastener as appropriate.

A pinion supporting part 335 to which the pinion 52 is coupled may be formed at one side of the bracket 56, and spaced apart by a predetermined distance from the bracket 56 so as to communicate with the driving motor 51. In certain embodiments, the pinion supporting unit 335 may be formed integrally with the bracket 56. In the embodiment shown in FIG. 4, the pinion supporting part 335 is provided to the rear of the bracket 56. The pinion supporting unit 335 may include grooves onto which the pinion 52 may be mounted and rotated.

In alternative embodiments, the fixing rail 32 may be slideable like the moving rail 33. In other words, the rail guide 31 may include a guide part in which the fixing rail 32 may be received, and the fixing rail 32 may be slidably coupled to the guide part so that the door 17 has a multi-stage movement structure.

The moving rail 33 may be coupled to the rail connector 34. The front end of the rail connector 34 may be fixed to the rear/interior surface of the door 17. In certain embodiments, a door liner 172 may protrude from an edge of the rear surface of the door 17, and the rail connector 34 may be coupled to the interior side of the door liner 172. Therefore, when the moving rail 33 slides, the door 17 also slides and the upper portion of the freezing chamber 12 may be selectively opened and closed. The upper end of the rail connector 34 may be curved toward the interior of the freezing chamber 12 to form a seating part 341 that seats the supporting part 311 so that the weight of items stored in the receiving box 175 is dispersed, making it possible to more stably operate the slide assembly 30.

The hooking ring 345 may be provided at the lower end of the rail connector 34, at a position corresponding to the receiver 333, and may have a hook shape so as to be inserted into the groove formed by the receiver 333. An opposite side of the lower end of the rail connector 34 may be coupled to the moving rail 33 by a bolt or other fastener as appropriate. Therefore, the rail connector 34 and the moving rail 33 may be decoupled and both the door 17 and the rail connector 34 may be separated from the refrigerator 1 by simply releasing the hooking ring 345 from the receiver 333.

The seating part 341 may include a receiving box fixing groove 347 that removably engages the receiving box 175. The receiving box 175 may be directly inserted into the receiving box fixing groove 347, or may be inserted in the fixing groove 347 through separate fixing member.

A gasket 177 may surround the outer periphery of the door liner 172. The gasket 177 may be adhered to a corresponding front face of the main body 10 so as to block communication between the inside and outside of the freezing chamber 12 when the door 17 is closed and form a seal therebetween. The gasket 177 may be formed of soft materials such as, for example, silicon, rubber, and the like to also absorb impact when the door 17 is closed.

The structure of the slide assembly 30 discussed above may be applied to both lateral sides of the freezing chamber 12 so that the door 17 may be smoothly drawn in and out. In certain embodiments, the bracket 56 may be provided with only one of the two moving rails 33 at one side of the freezing chamber 12, and the driving motor 51 may be coupled to only one of the slide assemblies 30.

The driving motor 51 may be coupled to the bracket 56 and move together with the moving rail 33 forward and backward. The driving motor 51 may be surrounded by a motor housing 511, and a first rotational shaft 513*a* and a second rotational shaft 513*b* may protrude from opposite sides of the housing 511. The first rotational shaft 513*a* may be connected to a connection part 55, and the second rotational shaft 513*b* may be connected to the pinion 52. In certain embodiments, the rotational shafts 513*a* and 513*b* may be positioned along substantially the same line so that the rotational shafts 513*a* and 513*b* rotate together at the same time as the driving motor 51 operates. The rotational shafts 513*a* and 513*b* may be formed as a single shaft.

The driving motor 51 may be, for example, a three phase blushless DC (BL DC) motor, a single phase induction motor, or other driving source as appropriate. The driving motor 51 may include a plurality of hall sensors to sense the rotation of the driving motor 51. For example, a three phase blushless DC (BLDC) motor functions as the driving motor 51, three hall sensors may be provided, and two hall sensors may be provided with a single phase induction motor. The driving motor 51 may be controlled by a controller 500 so that the rotation speed of the driving motor 51 is variable.

In certain embodiments, a motor whose rotational shafts 513*a* and 513*b* may be rotated by an external force, even when power is not supplied to the motor, may function as the driving motor 51 so that the user can either automatically draw the door 17 in and out by applying power to the driving motor 51, or manually draw the door 17 in and out using the handle 171, without applying power to the driving motor 51.

The motor housing 511 may include a flange 515 that fixes the driving motor 51 to the moving rail 33, and in particular, to the bracket 56. The flange 515 may include a plurality of holes that receives appropriate fasteners that extend into the holes 561 in the bracket 56. Further, the flange 515 may be formed so that the pinion 52 inserted onto the second rotational shaft 513*b* may be connected to the pinion supporting part 335. In other words, the flange 515 may extend a predetermined length from the housing 511 so that when it is fixed to the bracket 56, the center of the pinion 52 may be rotatably connected to the pinion supporting part 335. Therefore, when the driving motor 51 is coupled to the bracket 56, the center of the pinion supporting part 335, the center of the pinion 52, and the first rotational shaft 513*a* are all disposed on the same axis. In certain embodiments, the driving motor 51 is fixed to the moving rail 33 by the coupling of the flange 515 and the bracket 56, and the pinion supporting part 335 may be unnecessary.

The pinion 52 may be sized so that when it is inserted onto the pinion supporting part 335 its outer circumference engages with the rack 315 so that the pinion 52 moves along the rack 315. As the pinion 52 transfers the rotational force from the driving motor 51, the pinion 52 may be referred to as a rotational force transferring member. As the rack 315 guides the movement of the rotational force transferring member, the rack 315 may be referred to as a guide member.

The first rotational shaft 513*a* may be connected to a shaft 54 through the connection part 55. A first of the connection part 55 may include grooves corresponding to the shape of the first rotational shaft 513*a*, and a second end opposite the first end thereof may include grooves corresponding to the shape of the shaft 54. The first end of the connection part 55 is coupled to the first rotational shaft 513*a* and second end thereof is coupled to the shaft 54, so that the rotation of the rotational shaft 513*a* is transferred to the shaft 54. The shaft 54 may be fixed to the connection part 55 by a bolt, or other fastener as appropriate.

The shaft 54 extends across the freezing chamber 12 in a transverse direction, with a first end thereof connected to the connection part 55 and a second end thereof directly connected to a second pinion 53. This second pinion 53 is connected to the pinion supporting part 335 of the second slide assembly 30 provided at the second side wall of the freezing chamber 12, opposite the first slide assembly 30 provided at the first sidewall discussed above, such that it can be rotated. Therefore, when the rotational shafts 513 and 513*b* are rotated by the driving motor 51, such the pinions 52 and 53 on both sides are rotated at the same rotational speed.

The driving motor 51, the shaft 54, and the pinions 52 and 53 form a driving unit that slidably moves the slide assembly 30 and the door 17 and may be referred to a door driving assembly. In certain embodiments, the door driving assembly includes at least the driving motor 51 and the first pinion 52.

The driving motor 51 may be provided at the rear end of the moving rail 33. In order to prevent interference at the rear wall surface of the freezing chamber 12 when the door 17 is completely closed, the driving motor 51 may be formed or positioned at an incline to correspond to the shape of the rear wall of the freezing chamber 12.

Operation of the refrigerator 1 according to an embodiment as broadly described herein will now be discussed.

If the user inputs a drawing in or out command of the door 17 through the input unit 222, power is applied to the driving motor 51 to rotate the rotational shafts 513*a* and 513*b*.

In particular, if the drawing out command is input at the input unit 222, power is applied to the driving motor 51 so that the rotational shafts 513*a* and 513*b* rotate forward (the clockwise direction shown in FIG. 3). As a result, the pinions 52 and 53 also rotate clockwise and move forward along their respective racks 315, causing the respective moving rails 33 to also move forward. The moving rails 33 are guided by the guide parts 323, and the rail connectors 34 are fixed to the moving rails 33 such that receiving box 175 and the door 17 move together to provide access to the receiving box 175 for the insertion and/or removal of storage items.

If the drawing in command is input at the input unit 222, power is applied to the driving motor 51 so that the rotational shafts 513*a* and 513*b* rotate in a reverse direction (the counter-clockwise direction in FIG. 2). As a result, the pinions 52 and 53 also rotate counter-clockwise and move backward along their respective racks 315, causing the respective moving rails 33 to move backward and the door 17 to close the upper portion of the freezing chamber 12.

In a refrigerator 1 as embodied and broadly described herein, the receiving box 175 is automatically drawn in and out together with the upper door 17 by operating only the input unit 222 that receives the door drawing in and out commands input by the user, thus improving user convenience.

In addition, since the receiving box 175 is automatically drawn out, the receiving box 175 may be conveniently drawn out regardless of the weight of items received in the receiving box 175.

In addition, the driving motor 51 is not fixed to the main body 10, but instead movably provided together with the receiving box 175, so that the volume of the inside of the refrigerator 1 is not reduced by the volume of the motor 51.

In addition, the driving motor 51 is not fixed to the main body 10, but is instead movably provided together with the receiving box 175, so that a reduction in the heat shield effect due to a reduction in the heat shield layer of the main body 10 is not experienced.

Moreover, when the driving motor 51 is movably provided together with the receiving box 175, making it possible to sufficiently use the space between adjacent receiving boxes may be used efficiently.

Further, the driving motor 51 is not directly connected to the rail connector 34 which is directly connected to the upper door 17, but is instead indirectly connected through the moving rail 33, making it possible to conveniently attach and detach the upper door 17 if necessary.

Further, the guide that guides the movement of the receiving box 175 is not subjected to the restriction of the machine room and thus may be formed sufficiently long in the front and rear direction of the main body so that the upper door 17 and the receiving box 175 may be fully drawn out, providing full access to the inner space of the receiving box 175.

Figure 5:
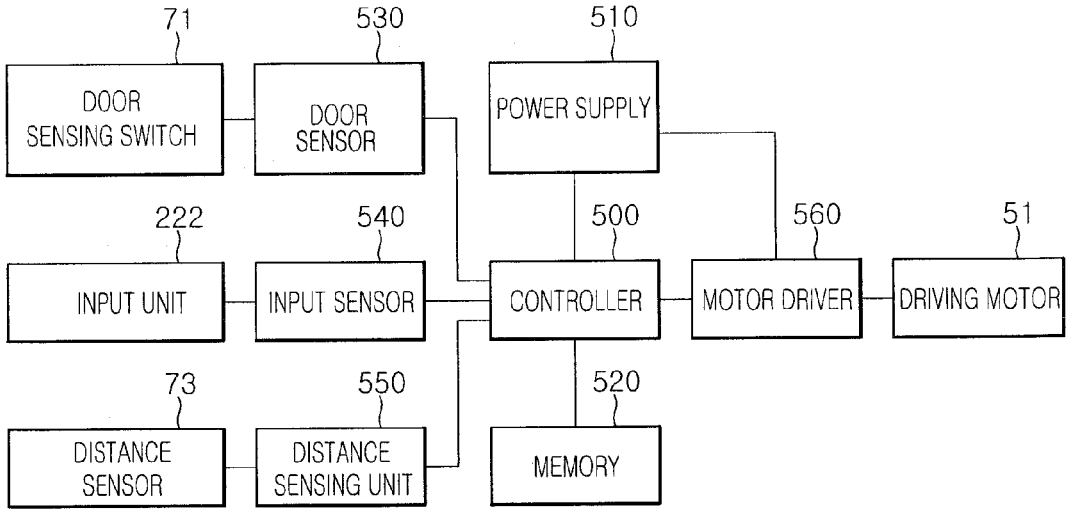
FIG. 5 is a block diagram of control components of a refrigerator according to an embodiment as broadly described herein.

Hereinafter, a method for controlling the refrigerator 1 having the above configuration will be described with respect to FIGS. 5 and 6. As shown in FIG. 5, the refrigerator 1 may include the controller 500 that controls a power supply 510 that supplies power each component of the refrigerator 1, a memory 520 that stores information related to operation of the refrigerator 1, a door sensor 530 that senses whether the door 17 is opened or closed, an input sensor 540 that senses that a command has been received by input unit 222, a distance sensing unit 550 that senses a distance from the door 17, and a motor driver 560 that controls the operation of the driving motor 51 such as, for example, by controlling a voltage, applied to the driving motor 51.

The power supply 510 may also be connected to the motor driver 560 to supply power to the driving motor 51. In this case, the motor driver 560 may switch (for example, switching a DC voltage into an AC voltage) a waveform of power supplied from the power supply 510 and may supply it to the driving motor 51. In addition, the motor driver 560 may include a processor that controls the driving motor 51, any hall sensors, and the like.

A door sensing switch 71 that senses whether the door 17 is opened or closed may be provided at one side of the main body 10. The door sensing switch 71 may include, for example, a pressing switch, such that when the door 17 is closed, the pressing switch is pressed and when the door 17 is opened, it is not pressed and extends outward. A signal generated by the door sensing switch 71 may be transmitted to the controller 500 through the door sensor 530.

The input sensor 540 is connected to the input unit 222 and transmits an input/received command to the controller 500. For example, when the input unit 222 is provided as a single button, the input sensor 540 transmits a signal informing the controller 500 that the single button has been pressed. The controller 500 may then determine that the desired action is the opening or closing of the door 17 according to whether the door 17 is currently opened or closed.

The distance sensing unit 550 may be connected to a distance sensor 73. The distance sensor 73 may sense a distance the door 17 or the receiving box 175 has moved. The distance sensor 73 may be a sensor using, for example, infrared rays or ultrasonic waves, or other distance measuring devices as appropriate. The distance sensor 73 may be mounted on, for example, the rear wall surface of the freezing chamber 12 to sense a distance between the rear surface of the receiving box 175 and the rear wall surface of the freezing chamber 12, or may be mounted on the front surface of the main body 10 to measure the distance between the main body 10 and the door 17. Other arrangements may also be appropriate.

In alternative embodiments, the motor driver 560 may calculate a number of rotations of the driving motor 51 based on a signal generated the hall sensor included in the driving motor 51 and estimate the distance the door 17 and the receiving box 175 has moved based on the number of rotations. The distance the moving rail 33 has moved may be calculated by multiplying $\pi$ by a diameter of the pinion 52 and then multiplying the product by the number of rotations of the driving motor 51. This will correspond to the distance the door 17 has moved. In this case, the hall sensor of the driving motor 51 may function as the distance sensor 73 and the motor driver 560 may function as the distance sensing unit 550.

The motor driver 560 receives a control signal from the controller 500 to drive the driving motor 51. The motor driver 560 may also apply power supplied from the power supply 510 to the driving motor 51 under the control of the controller 500. The memory 520 may store various set values necessary for driving the driving motor 51 in the controller 500.

Figure 6:
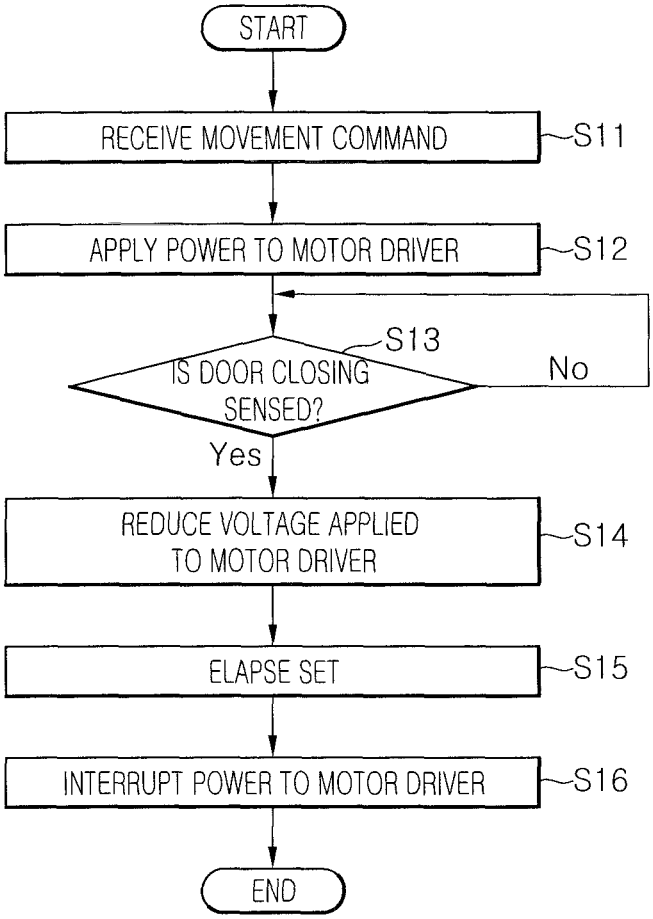
FIG. 6 is a flowchart of a method of controlling a refrigerator according to an embodiment as broadly described herein.
Figure 7:
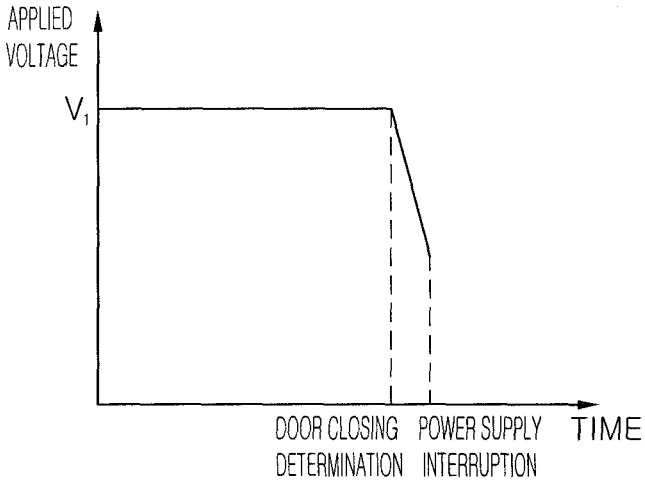
FIG. 7 is a graph of voltage applied to a motor driver over time in accordance with the method shown in FIG. 6.

FIG. 6 is a flowchart of a method for controlling a refrigerator according to an embodiment. As broadly described herein, and FIG. 7 is a graph of voltage applied to the motor driver over time.

First, the input sensor 540 senses whether a drawing in command of the upper door 17 has been input (S11).

When the input unit 222 comprises a single button and the drawing out and drawing in commands are input using this single button, an input may be determined to be a drawing in command when the upper door 17 is opened (the drawn out case), and a drawing out command when the upper door 17 is closed (the drawn in case). Whether the upper door 17 is opened or closed may be determined by, for example, the door sensing switch 71, the distance sensor 73, or other means as appropriate.

When a drawing in command of the upper door 17 is input, the input sensor 540 transmits a signal to the controller 500, and the controller 500 applies a predetermined power to the motor driver 560 (S12). The applied voltage may be assumed to be V1.

The power supply 510 continuously supplies power to the motor driver 560 until the of the door sensor 530 senses that the upper door 17 is closed (S13). Voltage applied to the motor driver 560 may be maintained at V1 so that the driving motor 51 rotates at a constant rotation speed and the upper door 17 is drawn in at a constant speed.

In order to completely block the inside of the freezing chamber 12 from the outside and prevent leakage of cool air, the upper door 17 may be closely adhered to the main body 10 with the gasket 177 compressed therebetween. However, the upper door 17 moves at a predetermined speed due to the rotation of the driving motor 51, and thus may impact the main body 10 with a predetermined amount of impact force. The gasket 177, which may be made of a soft material and provided on the rear surface of the upper door 17, may cause the upper door 17 to be repelled if the gasket 177 is not sufficiently compressed. Therefore, there is a risk that cool air inside the freezing chamber 12 will be leaked.

This phenomenon may occur due to the characteristics of the door sensing switch 71. That is, there is a difference between the moment at which the closing of the upper door 17 is sensed the door sensing switch 71 and the moment at which the upper door 17 is closely adhered to the main body 10 so that the gasket 177 is sufficiently compressed. Generally, the point at which it is sensed that the upper door 17 is closed will be followed by the point at which the gasket 177 is sufficiently compressed. In this case, when the rotation of the driving motor 51 stops at the point at which the closing of the upper door 17 is sensed, the gasket 177 may not be sufficiently compressed, risking leakage of cool air from inside the freezing chamber 12. To address this problem, in a method for controlling a refrigerator according to an embodiment as broadly described herein, power is supplied to the motor driver 560 for a predetermined setting time even though a closing signal of the door 17 has been transmitted by the door sensor 530 (S14 and S15).

In other words, when it is determined that the upper door 17 is closed, power continues to be supplied to the driving motor 51 in order to further close adhere the upper door 17 to the main body 10 (S14). If, after the closing of the upper door 17 is determined, a predetermined level of voltage is supplied and is then suddenly interrupted, a repulsive force may be generated, thus risking that the upper door 17 will be repelled and pushed forward. In order to prevent this, the controller 500 may control the voltage level applied to the motor driver 560 to decrease gradually after the closing of the upper door 17 is determined to reduce the load applied to the driving motor 51.

After the closing of the upper door 17 has been determined, power supply may be continued for a setting time (S15). The setting time may be set based on data obtained through testing and may be set within, for example, several milliseconds to several seconds, to prevent overload of the driving motor 51. Therefore, even though power is supplied to the driving motor 51, the upper door 17 moves a very small distance corresponding to a compression distance of the gasket 177.

The controller 500 terminates the drawing in process of the upper door 17 by interrupting power supplied to the motor driver 560 (S16).

In the method shown in FIG. 6 and described above, even after the closing signal of the upper door 17 has been received by the controller 500, the gasket 177 is compressed by applying a voltage to the driving motor 51 for a constant time and further closing the upper door 17 and closely adhering the upper door 17 to the main body 10 such that the freezing chamber 12 may be sealed, leakage prevented, and power consumption reduced.

Figure 8:
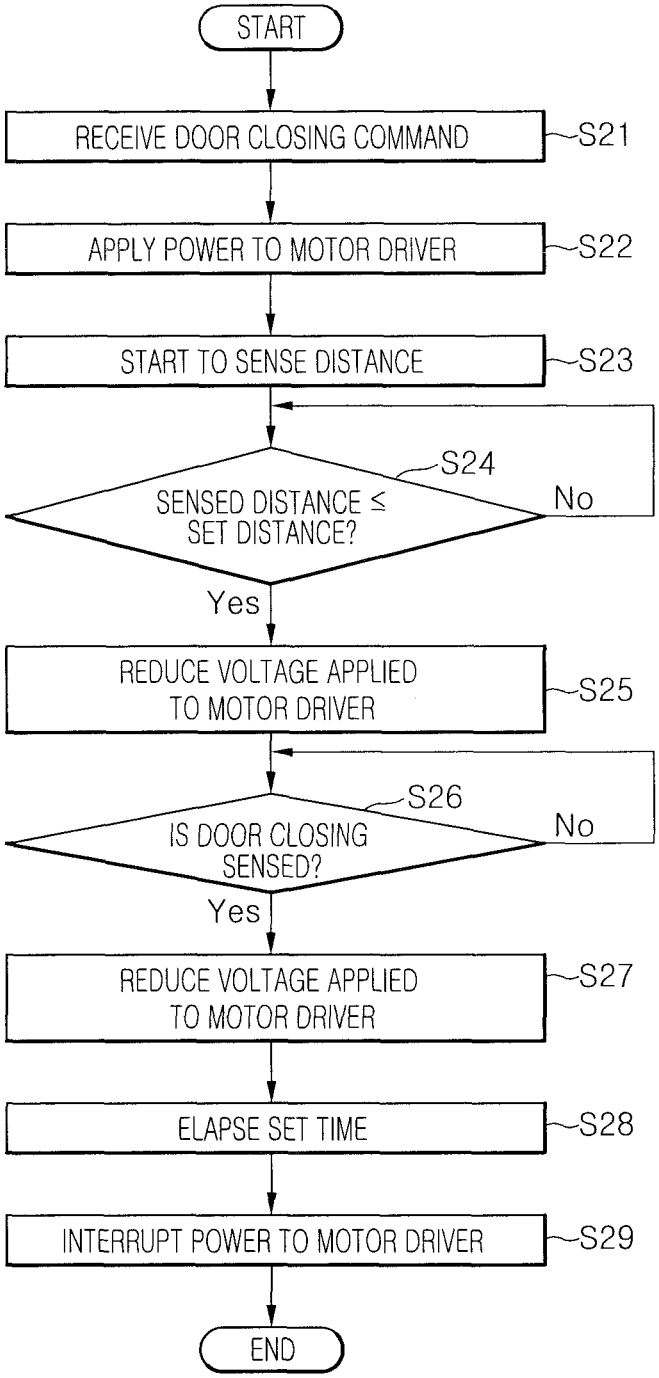
FIG. 8 is a flowchart of a method for controlling a refrigerator according to a another embodiment as broadly described herein.

Hereinafter, a method for controlling a refrigerator according to another embodiment as broadly described herein will be described with reference to FIGS. 8 to 10. First, if the door drawing in command is input by the user (S21), the controller 500 applies power to the motor driver 560 (S22).

The distance sensing unit 550 begins sensing the distance from the upper door 17. The distance sensing unit 550 may continuously sense the distance from the upper door 17 and continuously transmit the sensed distance to the controller 500, and may compare a preset distance with the sensed distance transmitted from the distance sensing unit 550 (S34). The preset distance may be previously set in the memory 520.

The preset distance may be, for example, a safety distance that allows the user to remove his/her hand from the receiving box 175 in time if necessary during the drawing in process of the upper door 17. For example, when the upper door 17 maintains an initial speed (when an applied voltage is V1) and is closed, the user's hand may be caught in the receiving box 175 and the upper door 17. In order to prevent injury, the upper door 17 may be controlled to move at a slower speed than the initial speed through a predetermined section before the upper door 17 is completely closed. Therefore, the user may remove his/her hand while the upper door 17 moves at a relatively slow speed. The section where the upper door 17 moves at a relatively slow speed may be referred to as a safety section, and the moving speed may be reduced during the safety section before the upper door 17 is fully closed.

The controller 500 reduces a voltage size applied to the motor driver 560 so that when the upper door 17 is closer than the preset distance, i.e., within the safety section, it moves at a slower speed than the initial speed (S25). If a time for the upper door 17 to pass through the preset distance is assumed to be T1 or T2, the voltage applied to the motor driver 560 during the drawing in process of the upper door 17 may be changed as shown, for example, in FIG. 9 or FIG. 10.

Figure 9:
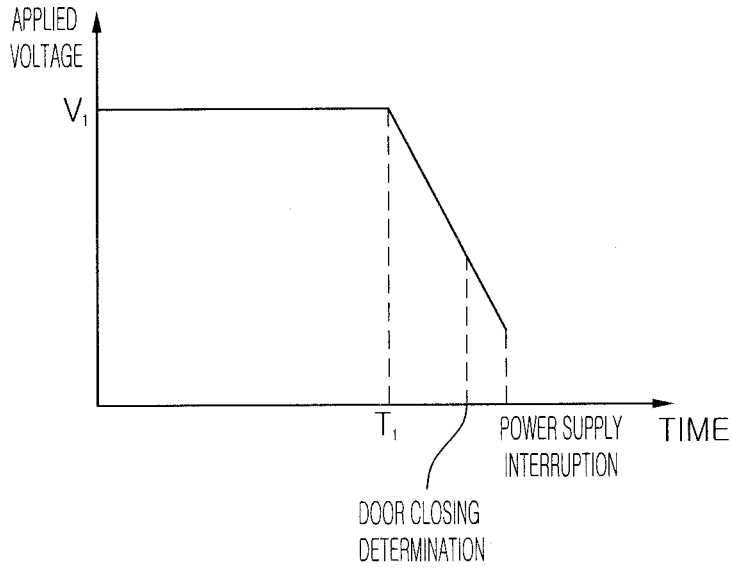
FIG. 9 is a graph of voltage applied to a motor driver over time in accordance with the method shown in FIG. 8.

Referring to FIG. 9, after the upper door 17 passes through the preset distance, the voltage applied to the motor driver 560 may be controlled to be smaller with the passage of time. In other words, as the upper door 17 gets nearer to fully closing, the upper door 17 gradually moves at a slower speed, allowing sufficient time for the user to remove his/her hand.

Figure 10:
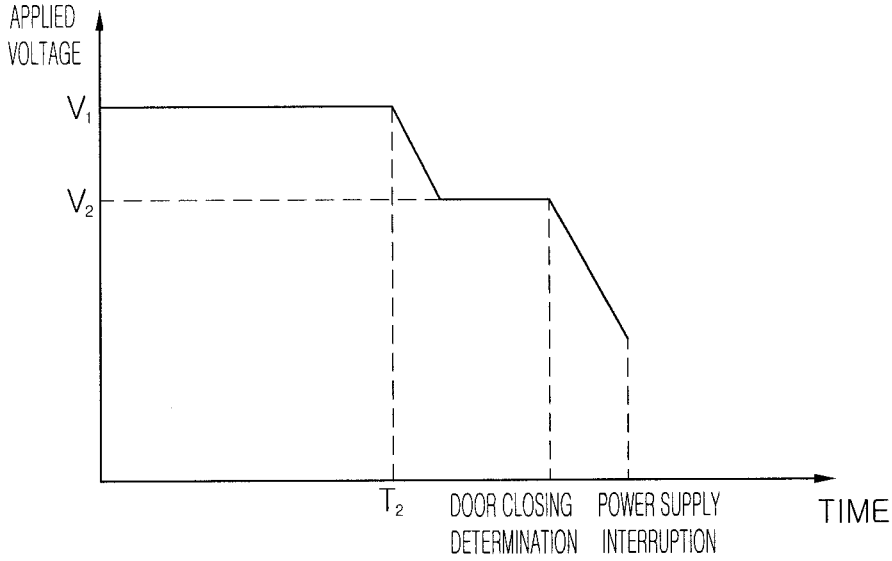
FIG. 10 is a graph in which voltage applied to a motor driver is changed over time in accordance with the method shown in FIG. 6.

Alternatively, as shown in FIG. 10, after the upper door 17 passes through the preset distance at time T2, a voltage V2 having a smaller size than an initial applied voltage V1 may be supplied to the motor driver 560 until the closing of the upper door 17 is sensed. In other words, the upper door 17 moves at a slower speed than the initial speed when it passes through the preset distance.

When the closing of the upper door 17 is sensed (S26), the controller 500 reduces the voltage applied to the motor driver 560 (S27), and after a predetermined time elapses (S28), interrupts power supplied to the motor driver 560 (S29) to terminate the drawing in process of the upper door 17.

Figure 11:
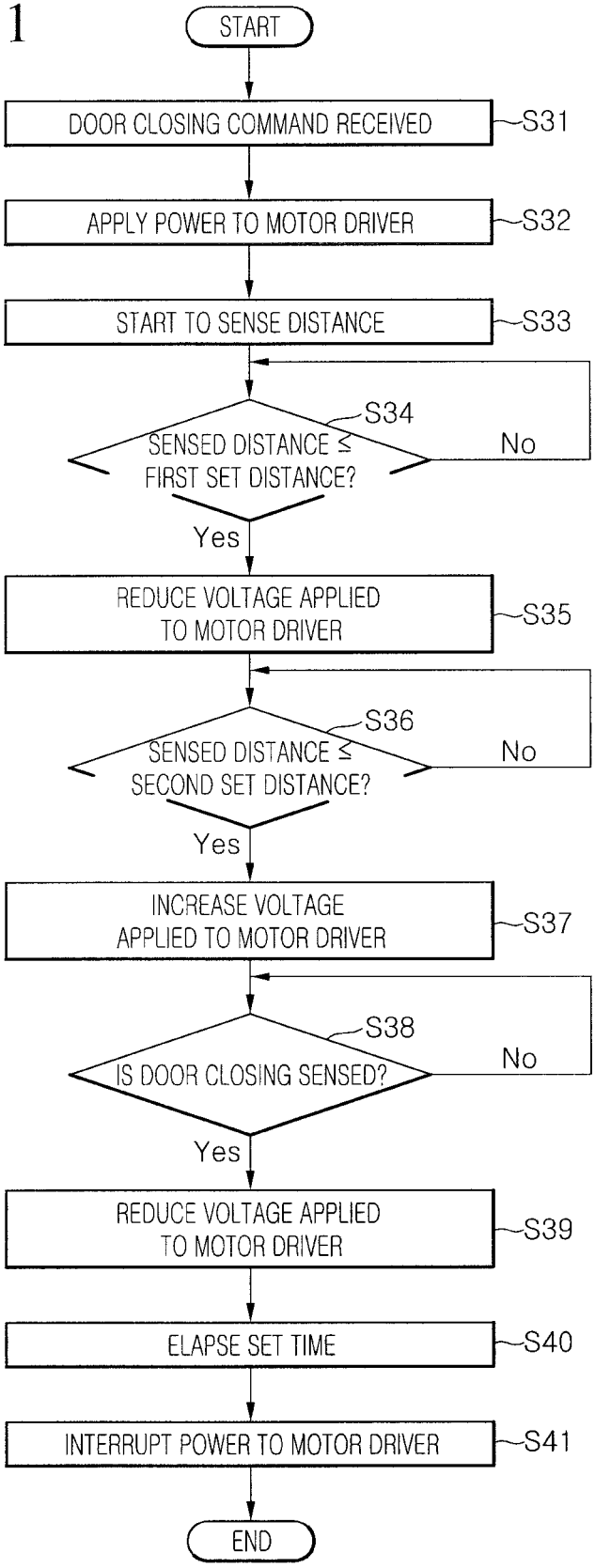
FIG. 11 is a flowchart of a method for controlling a refrigerator according to another embodiment as broadly described herein.
Figure 12:
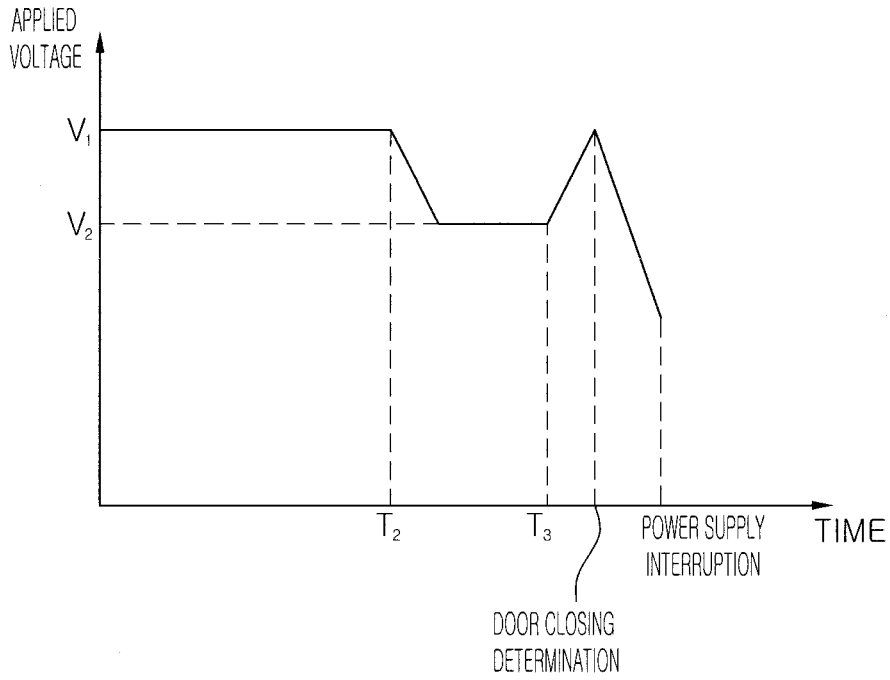
FIG. 12 is a graph of voltage applied to a motor driver over time in accordance with the method shown in FIG. 11.

Hereinafter, a method for controlling a refrigerator according to another embodiment as broadly described herein will be described with reference to FIGS. 11 to 12. First, if the door drawing in command is input by the user (S31), the controller 500 applies power to the motor driver 560 (S32).

The distance sensing unit 550 senses a distance from the upper door 17 (S33) and when the sensed distance is less than a first set distance, reduces a voltage applied to the motor driver 560 (S35). At this point, the controller 500 may gradually reduce voltage applied to the motor driver 560 and then maintain the voltage at a constant level after reducing the voltage by a predetermined amount. The first set distance may correspond to the set distance discussed with respect to the embodiment shown in FIGS. 8-10 and the aforementioned processes may correspond to steps S21 to S25 shown in FIG. 8.

When the speed of the upper door 17 at the point at which the upper door 17 is closed is slow, there may be a problem in ensuring that the upper door 17 is fully closed because of the repulsive force of the gasket 177. In order to prevent this, the controller 500 may at that point increase the voltage applied to the motor driver 560 immediately before the upper door 17 is closed.

In detail, the controller 500 reduces the voltage applied to the motor driver 500 (S35) and then compares whether the distance sensed by the distance sensing unit 550 is less than or equal to the second set distance (S36). The second set distance is a distance that is spaced apart by several mm to several cm from the main body and corresponds to the section where the upper door 17 is accelerated before it is fully closed.

If the sensed distance is less than or equal to the second set distance, the controller 500 increases the voltage applied to the motor driver 560 (S37). Therefore, the upper door 17 is closely adhered to the main body 10 at a rapid speed, such that it may be certainly closed. If a time when the upper door 17 passes through the second set distance is assumed to be T3, the voltage applied to the motor driver 560 during the drawing in process of the upper door 17 may be changed as shown in FIG. 12.

When the closing of the upper door 17 is sensed (S38), the controller 500 reduces the voltage applied to the motor driver 560 (S39), and after a predetermined time elapses (S40), power supplied to the motor driver 560 is interrupted (S41) to terminate the drawing in process of the upper door 17.

In the above described embodiments, the refrigerator 1 is controlled so as to certainly close the upper door 17.

In addition, the movement speed of the upper door 17 and the receiving box 175 is lowered during the predetermined section before the upper door 17 is closed, such that the user has sufficient time to remove his/her hand from the receiving box 175, thereby injury.

Additional information regarding the structure and function of a drawer type refrigerator may be found in U.S. application Ser. Nos. 12/390,520, 12/390,523, 12/390,524, 12/390,527 and 12/510,372, which are incorporated herein by reference.

A refrigerator is provided that is capable of automatically drawing out the receiving box depending on the selection of a user and a method for controlling the same.

A refrigerator is provided that is capable of securing the volume of the inside of the refrigerator and preventing the degradation of heat shield performance while providing a function of automatically drawing in and out a receiving box and a method for controlling the same.

A refrigerator is provided that is capable securing a volume of the inside of the refrigerator even when a plurality of automatically drawing in and out receiving boxes are continuously formed and a method for controlling the same.

A refrigerator is provided that is capable of easily attaching and detaching a drawn in and out door together with a receiving box to the refrigerator and a method for controlling the same.

A refrigerator is provided that is capable of automatically drawing in and out a receiving box and then conveniently receiving foods in an inner space of the receiving box and a method for controlling the same.

A refrigerator is provided that is capable of improving airtight reliability of a receiving box and a method for controlling the same.

A refrigerator is provided that is capable of preventing a problem in that a user's hand is caught in a receiving box at the time of drawing in the receiving box and a method for controlling the same.

A refrigerator according to an embodiment as broadly described herein may include a main body that has a storage space storing foods at low temperature; a door that straightly moves to selectively open and close the storage space; a receiving box that is mounted on a rear of the door and straightly moves together with the door; a slide assembly that is mounted on a side wall of the storage space and straightly moves the door; a driving motor that is mounted on the slide assembly and providing a driving force for moving the door; and a controller that drives the driving motor for a setting time even after the door is closed.

A method for controlling a refrigerator according to an embodiment as broadly described herein may include transmitting a drawing in order of a door to a controller; applying power to a driving motor that provides moving force to the door; and determining whether the door is closed, wherein a voltage is applied to the driving motor even after it is determined that the door is closed.

In a refrigerator and method as embodied and broadly described herein, the receiving box is automatically drawn in and out together with the door only by the operation that the user operates an input unit inputting the door drawing in and out orders, thereby increasing the use convenience of children and old people.

In addition, since the receiving box is automatically drawn out the receiving box can conveniently be drawn out regardless of the weight of foods received in the receiving box.

Further, since the driving motor for automatically drawing out the receiving box is not fixedly mounted to the main body of the refrigerator and can be moved together with the receiving box, the volume of the inside of the refrigerator is removed.

Also, since the driving motor is not fixedly mounted to the main body and can be moved together with the receiving box, the heat shield effect is reduced due to the reduction in the thickness of the heat shield layer of the main body.

Moreover, when the receiving box can be automatically drawn in and out continuously, the driving motor is movably provided together with the receiving box, making it possible to sufficiently use the space between the continued receiving boxes.

Moreover, the driving motor is not directly connected to the components that are connected to the door, making it possible to conveniently attach and detach the door if necessary.

Further, the guide guiding the movement of the receiving box is formed to be sufficiently long in the front and rear direction of the main body to draw out the door and the receiving box, making it possible to conveniently receive foods in the inner space of the receiving box.

In addition, a voltage is applied to the driving motor for a predetermined time even after the door is closed, making it possible to completely close the door.

In addition, the movement speed of the door and receiving box is lowered for a predetermined section before the door is closed, making it possible to provide time until the user hand can take out from the receiving box.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method for controlling a refrigerator, the method comprising:

transmitting a door closing command to a controller;

applying power to a driving motor that transmits a moving force to the door, comprising varying an applied voltage so that a rotation number of the driving motor is reduced before the door is closed;

determining whether the door is closed; and continuing to supply power to the driving motor for a preset time even after it is determined that the door is closed, wherein varying the applied voltage comprises:

reducing the rotation number of the driving motor and then maintaining the reduced rotation number; and increasing the rotation number of the driving motor immediately before the door is fully closed.

2. The method of claim 1, wherein determining whether the door is closed is based on at least one of a signal transmitted from a door sensing switch, a distance to the door sensed by a distance sensor, or a moving time of the door.

3. The method of claim 1, further comprising after it is determined that the door is closed, applying a voltage to the driving motor that is lower than a voltage applied at the moment that the door is closed.

4. The method of claim 3, further comprising, after it is determined that the door is closed, gradually reducing a voltage applied to the driving motor.

5. The method of claim 1, further comprising after it is determined that the door is closed, applying a voltage to the driving motor that is lower than a voltage applied at the moment that the door is closed.

6. The method of claim 1, further comprising, after it is determined that the door is closed, gradually reducing a voltage applied to the driving motor.

7. A method for controlling a refrigerator, the method comprising:

transmitting a door closing command to a controller;

applying power to a driving motor that transmits a moving force to the door;

determining whether the door is closed; and continuing to supply power to the driving motor for a preset time even after it is determined that the door is closed, wherein applying power to the driving motor comprises controlling a voltage applied to the driving motor so that a rotation number of the driving motor is increased immediately before the door is closed.

8. The method of claim 7, wherein determining whether the door is closed is based on at least one of a signal transmitted from a door sensing switch, a distance to the door sensed by a distance sensor, or a moving time of the door.

9. A method for controlling a refrigerator, the method comprising:

transmitting a door closing command to a controller;

applying power to a driving motor that transmits a moving force to the door sensing a distance of the door from a distance sensing unit when the door is in an opened position;

reducing a voltage applied to a motor driver when the distance is determined by the distance sensing unit to be equal to or less than a first set distance;

maintaining the voltage at a constant level after reducing the voltage by a predetermined amount;

reducing the voltage for a predetermined time, when a door sensor senses the door is closed; and interrupting the voltage when the predetermined time elapses after the door is closed, to terminate the drawing in process of the door.

10. The method of claim 9, wherein the voltage at the constant level is maintained until the door sensor senses the door is closed.

11. The method of claim 9, further comprising continuously sensing the distance of the door from the distance sensing unit after reducing the voltage at the first set distance, wherein the voltage at the constant level is maintained until the distance determined by the distance sensing unit is to be equal to or less than a second set distance.

12. The method of claim 11, further comprising:

increasing the voltage when the distance is equal to or less than the second set distance and until the door sensor senses the door is closed.

* * * * *